US006220988B1

(12) United States Patent
Williams

(10) Patent No.: US 6,220,988 B1
(45) Date of Patent: Apr. 24, 2001

(54) EXERCISE BAR

(76) Inventor: Michael E. Williams, 2459 N. Hearthside, Orange, CA (US) 92665

( * ) Notice: Subject to any disclaimer, the term of this patent is extended or adjusted under 35 U.S.C. 154(b) by 0 days.

(21) Appl. No.: 09/296,021

(22) Filed: Apr. 21, 1999

(51) Int. Cl.[7] ..... A63B 1/00
(52) U.S. Cl. ..... 482/38; 482/39; 482/108
(58) Field of Search ..... 482/38–42, 99, 482/102, 103, 106, 108, 139, 39, 83, 89; 248/200, 205.1, 226.11, 121

(56) References Cited

U.S. PATENT DOCUMENTS 4,306,389 * 12/1981 Bucker ..... 52/11

* cited by examiner

*Primary Examiner*—Jerome W. Donnelly
*Assistant Examiner*—Lori Baker Amerson

(74) *Attorney, Agent, or Firm*—Stetina Brunda Garred & Brucker

(57) ABSTRACT

An improved exercise bar for performing chin-up and pull-up exercises. According to a preferred embodiment, the exercise bar comprises an elongate member having a first upper arcuate portion extending along the length thereof and an angled portion extending downwardly therefrom. A third portion extends from the second angled portion and is preferably oriented such that, in use, the same is in generally perpendicular orientation with level ground. The first arcuate portion is designed to support the phalanx bones of the fingers, whereas the second angled portion supports the bones and muscles located in the palmar sections of the hands. The third portion supports the distal-most ends of the wrist bones. The exercise bar may be mountable upon a wall or may be formed as part of a free-standing apparatus. The exercise bar may further be formed to have a generally arcuate shape for the performance of wide-grip pull-up exercises, or may further include an attachment mechanism for use in lat pull-down exercises.

16 Claims, 4 Drawing Sheets

*Fig.3*
*(Prior Art)*
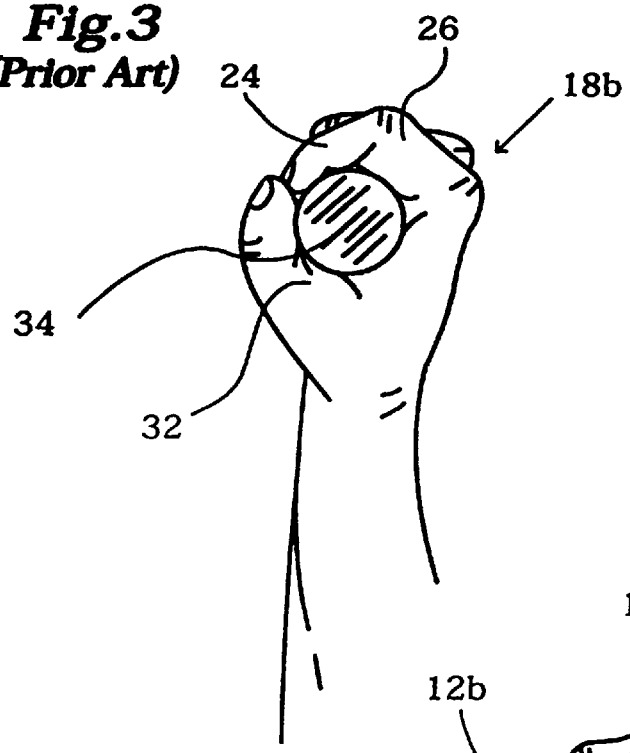
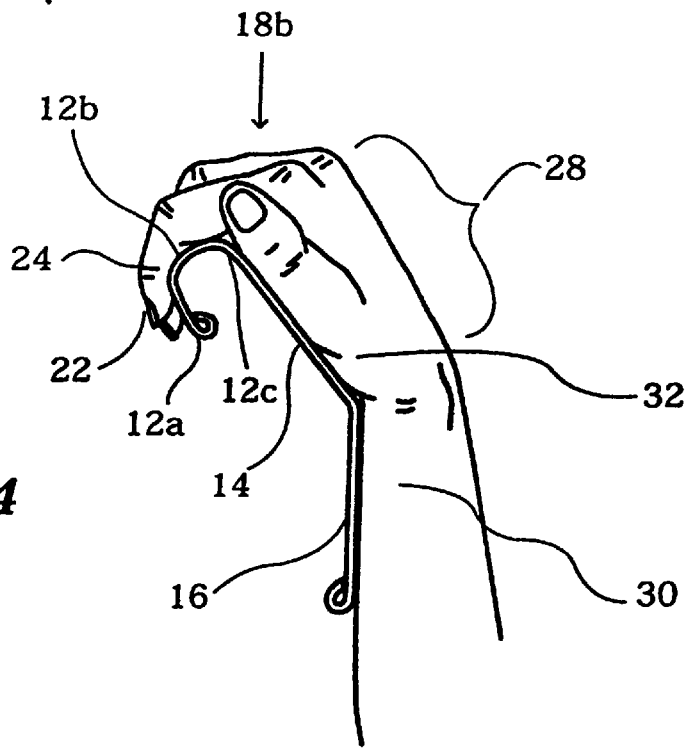
*Fig.4*

EXERCISE BAR

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The exercises of chin-ups and pull-ups have been known for decades as an excellent means for conditioning the upper body. In this regard, the individual performing such exercises grabs an elevated bar, which typically comprises an elongate, tubular structure, with both hands and repetitiously pulls himself or herself upwardly such that the head and chin extend over the bar. Thereafter, the individual descends such that he or she loosely hangs from the elevated bar. To perform chin-ups, the individual grasps the elevated bar such that the palms of each respective hand face inwardly toward the individual as the individual performs the exercise. Pull-ups, in contrast, require the individual to grasp the elevated bar such that the individual's palms face outwardly during the performance of such exercises.

Both chin-ups and pull-ups are known to be particularly effective in strengthening and toning the muscles of the upper body. Specifically, each respective exercise is ideal in developing the bicep, tricep, deltoid, trapezius, pectoralis major and latissimus dorsi muscle groups. In this regard, the chin-up and pull-up motion provides controlled movement of the limbs and relies upon coordinated relaxation and contraction of opposing muscles. For example, to raise the body during chin-up exercises, the biceps contract and shorten while the triceps relax. The reverse scenario occurs when the body is lowered.

Notwithstanding the effective and efficient conditioning that is provided by chin-up and pull-up exercises, such exercises suffer from significant drawbacks. The most significant of these drawbacks is the fact that most individuals lack the upper body strength to perform so much as even one chin-up or pull-up. In this regard, it is recognized that both chin-ups and pull-ups require a requisite degree of upper body strength to perform the same. Such requisite strength level, however, is lacking in most individuals insofar as most individuals either never have or fail to regularly exercise.

The other significant drawback of such exercises is due to the fact that to perform such exercises, the entire weight of the individual must necessarily be supported by the hands of the individual, and in particular the flexor muscles thereof. In this respect, the individual must tightly clench the elevated bar which causes the flexor muscles of the hand, and in particular the adductor muscles of the thumb and fingers, as well as the interosseous muscles of the palm, to quickly become sore due to a rapid development of lactic acid that builds up therewithin as caused by the stress and strain of having to pull and lift the weight of the individual against the force of gravity. As such, even to the extent the individual possesses upper body strength to perform multiple repetitions of either chin-ups or pull-ups, such inability to continuously hold onto the elevated bar and support the body's weight for a sufficiently long duration prevents the individual from maximizing the benefit to be derived from such exercise.

In an attempt to address such shortcomings posed by the inability of many to perform chin-up and pull-up exercises, at least one manufacturer, namely, Stairmaster Exercise Systems, Inc. of Tulsa, Oklahoma, has devised an exercise device sold as the Gravitron® (a registered trademark of Stairmaster) which enables individuals to perform chin-up and pull-up exercises at a controlled rate that minimizes hand muscle fatigue. Such device comprises a network of support bars for performing, inter alia, pull-ups and chin-ups, in combination with a programmable pneumatic platform device that provides selective degrees of support to the legs of the user to thus enable the user to do multiple repetitions of chin-ups, pull-ups, and the like that the individual would not otherwise be able to perform. Such system, however, is known to be extremely expensive and is typically only utilized in sophisticated workout facilities. Additionally, due to the sophisticated equipment utilized in the operation of such exercise system, such system is known to require substantial routine maintenance and must necessarily be kept indoors at all times, which thwarts the ability of chin-up and pull-up exercises to be easily performed per conventional methods, insofar as such exercises typically require nothing more than a simple elevated bar.

Accordingly, there is a need in the art for an exercise bar that can be utilized for chin-up and pull-up exercises that more evenly distributes the stress and strain imparted to the bones, muscles and ligaments of the hands than prior art tubular exercise bars. There is additionally a need in the art for an improved exercise bar that facilitates the ability of individuals to perform multiple repetitions of chin-up and pull-up exercises by minimizing the degree of fatigue experienced by the individual's hands during the performance of such exercises that is of simple construction, may be readily fabricated from a wide variety of commercially available materials, and may be deployed as per conventional tubular exercise bars, whether it be indoors or outdoors.

BRIEF SUMMARY OF THE INVENTION

The present invention specifically addresses and alleviates the above-identified deficiencies in the art. In this regard, the present invention is directed to an exercise bar that distributes the stress and strain of the hands of an individual performing chin-up or pull-up type exercises and thus reduces hand muscle fatigue during the performance of such exercises to enable the individual to maximize the number of repetitions of such exercises he or she can perform. In this respect, the exercise bar of the present invention is specifically adapted to enable an individual to perform chin-up and pull-up exercises to a much greater degree and maximize upper body conditioning by substantially reducing, if not eliminating, the hand fatigue normally associated with such exercises.

According to a preferred embodiment, the exercise bar comprises an elongate member, formed from molded material or sheet material, having a first arcuate portion defining a semi-cylindrical proximal end that, in use, is designed to be positioned in a generally upward orientation. Depending from an opposed side of the first arcuate or semi-cylindrical portion is a second angled portion, from which depends a third downwardly extending portion. The arcuate portion is specifically designed and configured to define three support surface areas for the fingers of each hand, namely, a first support surface area for supporting the distal phalanx bones of each finger, a second support zone for supporting the middle phalanx bones, and a third zone for supporting the proximal phalanx bones. The second angled portion is specifically sized and adapted to provide support to the metacarpal bones of the hand, the distal and proximal phalanx of the thumb, and the lower portion of the palm of the individual's hands, as defined by the hamate, pisiform, capitate, triquetral, lunate, trapezium, trapezoid, and scaphoid bones. The third downwardly extending portion is designed to support the wrists of the individual's hands, and in particular the distal-most portions of the ulna and radius bones.

By distributing the weight of the individual about the bones, tendons and muscles of the hand, substantial stress and tension is minimized in the hand during the performance of pull-up and chin-up type exercises. In this respect, the exercise bar of the present invention eliminates the need for the individual to tightly grip the exercise bar, as occurs with typical tubular bars, which place tremendous stress on the flexor muscles of the hand to support the weight of the individual during the performance of such exercises.

In alternative embodiments, such exercise bar may be modified such that the same has a generally arcuate shape defining curved end portions to facilitate the performance of wide-grip pull-ups. Still further, the exercise bar of the present invention may be provided with an attachment apparatus so that the same may be affixed to cable/pulley fixtures of conventional fitness machines for use in the performance of "lat pull-downs" for strengthening the latissimus dorsi muscle groups, as well as a variety of other strengthening exercises.

It is therefore an object of the present invention to provide an improved exercise bar that enables individuals to perform pull-up and chin-up type exercises that minimize the degree of hand strain associated with the performance of such exercises.

Another object of the present invention is to provide an exercise bar that more evenly distributes the weight of an individual about the bones, tendons and muscles of the hands thereof during the performance of chin-up and pull-up type exercises.

Another object of the present invention is to provide an exercise bar that can be utilized by individuals to perform wide-grip pull-up exercises and pull-down (i.e., lat pull-down) type exercises that likewise minimizes the degree of hand strain associated with the performance of such exercises and more evenly distributes the force imparted to the hands of an individual performing such exercises.

Still further objects of the present invention are to provide an exercise bar that is of simple construction, may be easily and readily fabricated from existing materials, is inexpensive to deploy and maintain, and may be utilized in both indoor and outdoor applications, with or without conventional exercise machines.

BRIEF DESCRIPTION OF THE DRAWINGS

These, as well as other features of the present invention will become more apparent upon reference to the drawings wherein:

FIG. 3 is a side perspective view of the hand of an individual grasping a tubular prior art exercise bar to perform pull-up exercises.

FIG. 4 is a side perspective view of the hand of an individual grasping the exercise bar of the present invention to perform pull-up exercises.

DETAILED DESCRIPTION OF THE INVENTION

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Figure 1:
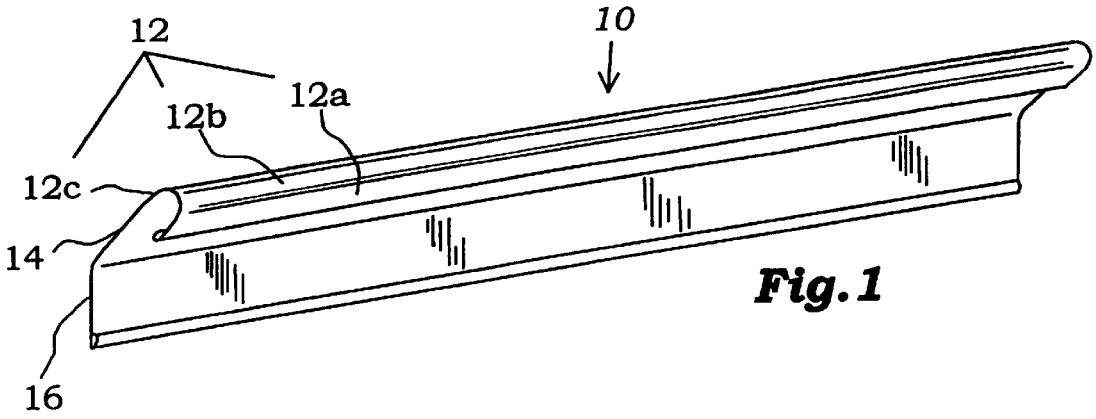
FIG. 1 is a perspective view of an improved exercise bar constructed in accordance with a preferred embodiment of the present invention.

Referring now to the drawings, and initially to FIG. 1, there is perspectively illustrated an improved exercise bar 10 for performing chin-up and pull-up exercises constructed in accordance to a preferred embodiment of the present invention. As is well-known in the art, chin-up, pull-up and pull-down exercises provide fast and effective means for developing upper body conditioning insofar as the same are known to exercise the bicep, tricep, deltoid, trapezius, pectoralis major and latissimus dorsi muscle groups of the body. Such exercises are additionally advantageous insofar as the same may be readily and easily performed insofar as all that is required is that the bar be elevated, such as the one depicted in FIG. 2, from which the individual may hang. In this regard, both chin-up and pull-up type exercises rely on nothing more than the individual 20 pulling his or her weight upwardly against the force of gravity.

Figure 2:
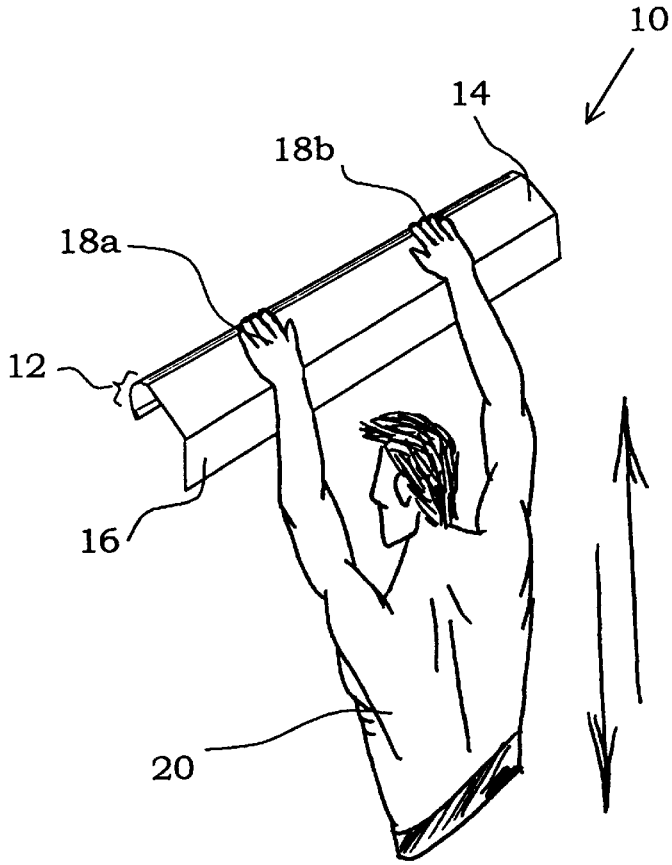
FIG. 2 is a rear perspective view of the upper body of an individual performing a pull-up exercise by utilizing the exercise bar depicted in FIG. 1.

To perform such exercises, however, requires that the individual 20 support all of his or her weight during such exercises by grasping the elevated bar 10, as depicted in FIG. 2. In this regard, the individual 20 grasps the bar 10 such that the palms of the hands 18*a,* 18*b* are wrapped therearound, with the palms being oriented in an inward configuration during chin-up exercises or an outwardly-facing configuration for doing pull-up exercises. In either case, it is necessary for the bones, muscles and tendons of the hand to become wrapped around the prior art exercise bar 34 which typically comprises a tubular bar made of metal, such as iron, as illustrated in FIG. 3. To maintain such grasp, however, exacts a tremendous toll on the tendons and muscles of the hand 18*b,* and in particular the adductor muscles of the thumb and fingers, as well as the interosseous muscles of the palm. In this respect, by virtue of having to continuously grasp the bar to support the weight of the individual, coupled with the fact that the individual is undergoing rigorous exercise activity, the muscles in the individual's hands are caused to rapidly produce lactic acid, indicative of anaerobic activity which occurs during strenuous muscle exercises, which eventually cause fatigue and prevent the individual from continued grasping activity and hence inability to perform any further exercises.

Moreover, the individual must grasp the bar such that the individual's hand 18*b* compresses radially about the tubular bar. Such configuration, however, forces the individual to compress the palm 32 of the hand 18*a* upwardly against the downwardly facing portion of the tube 34 which not only produces greater muscle fatigue as discussed above, but, due to the compressive force imparted by the palm 32 against the bar 34, further restricts the ability of blood to flow freely through the hand, which further exacerbates the ability to hold onto the bar for prolonged lengths of time. Additionally, due to the small diameter associated with most conventional exercise bars 34, the weight of the individual is not distributed evenly about the bones of the hand, which thus causes all of the weight of the individual to be selectively applied to a very limited area, and in particular the middle 24 and proximal 26 phalanx bones of the individual's hands.

The improved exercise bar 10 of the present invention specifically addresses such shortcomings associated with the performance of chin-up and pull-up type exercises by substantially reducing the stress and strain imparted to the hands during the performance of chin-up and pull-up type exercises. As shown in FIGS. 1, 2 and 4, the exercise bar 10, according to a first preferred embodiment, comprises a sheet of material formed to have zones or portions 12, 14, 16 for distributing the weight of an individual about the hands thereof when the individual grasps the same to perform chin-up and pull-up activities. Advantageously, the exercise bar 10 of the present invention eliminates the need of the individual to strain the flexor muscles of the hands to keep the individual suspended during the performance of such exercises.

In the embodiment shown, the exercise bar 10 includes a first elongate arcuate portion 12 formed about the top length thereof. The arcuate portion 12, which is preferably formed to be generally semi-cylindrical, and preferably has a diameter ranging from ½" to 2" with 1" being most preferred. The arcuate portion 12 is specifically designed to provide three zones 12*a*, 12*b*, 12*c* of support to the individual's hands when placed thereupon. Specifically, outwardly-facing zone 12*a* is designed to support the distal phalanx bones 22 of the little finger, ring finger, middle finger and index finger of the hands, as shown in FIG. 4. Top arcuate portion defines a second zone 12*b* that is designed to support the middle phalanx bones 24 of the little finger, ring finger, middle finger and index finger. The third zone 12*c*, formed on the opposed side of the first zone 12*a*, is designed to provide support to the proximal phalanx bones 26 of the little finger, ring finger, middle finger and index finger.

Depending from the arcuate support portion 12, and more particularly the third zone 12*c* thereof, is a first downwardly angled portion 14. Such downwardly-extending portion 14 is designed to provide support to the palmar portion 28 of the hand, and in particular the second, third, fourth and fifth metacarpal bones of the hand, as well as the distal and proximal phalanx and first metacarpal bones of the thumb. Such angled portion 14 further reduces stress associated with the superficial flexor muscles of the fingers, as well as the dorsal interosseous muscles of the hand. The angled portion 14 is specifically designed and configured to provide support to the lower portion of the palms 32 of the hand, and in particular the portion of the palms of the hand defined by the hamate, pisiform, capitate, triquetral, lunate, trapezium, trapezoid, and scaphoid bones. As will be appreciated by those skilled in the art, by providing such angled portion 14, the individual grasping the same is not caused to force such portion of the hand to extend upwardly and compress with the bottom portion of prior art tubular exercise bars, such as 34 depicted in FIG. 3, which is known to be a factor contributing to hand fatigue during chin-up, pull-up and/or pull-down type exercises. In this regard, such angled portion 14 reduces stress and strain on the adductor muscle of the thumb and the abductor muscle of the little finger.

The angled portion 14 is preferably formed to have an incline relative the first arcuate portion ranging anywhere from 20° to 70°. In a more preferred embodiment, the angled portion is angled outwardly approximately 45° relative the first arcuate portion 12. Additionally, it is believed that the angled portion 14 should be formed to have a length from approximately 2" to 6", with 3" being most preferred.

As further illustrated in FIGS. 1, 2 and 4, the exercise bar 10 of the present invention further preferably includes a third downwardly-extending panel portion 16, the latter depending from angled portion 14. As illustrated, the third portion 16 is designed and oriented to be generally perpendicular relative to level ground from its elevated position. In this regard, the third panel portion 16 is preferably configured to provide support to the wrist 30 of the user grasping the bar 10, and in particular, provides support to the distal-most ends of the ulna and radius bones of the arm. Although it will be recognized that such panel portion may have varying lengths, it is believed that the same preferably should have a length ranging from 2" to 6".

In addition to providing yet further support to the hands and wrists of the individual grasping the same, third portion 16 further acts to prevent the individual from improperly performing chin-up and pull-up exercises. In this regard, it is known that when individuals performing chin-up or pull-up exercises become weak, he or she has a tendency to swing about the exercise bar, which can occur with tubular exercise bars, in an attempt to build up momentum to pull his or herself upwardly over the bar. The third portion 16, however, prevents swinging motion by preventing the wrist from rotating thereabout. As a consequence, the individual performing such exercises is caused to work out the muscles sought to be strengthened, as opposed to feigning his or her way into performing more "repetitions."

The exercise bar 10 of the present invention is adapted to be grasped for purposes of performing either chin-ups, pull-downs, or pull-ups, the latter as depicted in FIG. 2. In this respect, the individual 20 utilizing such exercise bar grasps the bar 10 in the same manner irrespective of whether he or she is performing chin-ups or pull-ups, with the only difference being the orientation of the palms of the hands 18*a*, 18*b*. Specifically, the palms of the individual face inwardly for the purposes of performing chin-ups, or alternatively, as shown in FIG. 2, the palms will face outwardly to the extent the individual performs pull-ups.

As will be appreciated by those skilled in the art, the exercise bar of the present invention may be fabricated from any of a variety of materials, such as a metal including iron, aluminum, steel or titanium, as well as heavy-duty plastics, or may even be formed from wood and the like. Advantageously, the exercise bar of the present invention may be utilized in both indoor or outdoor applications and need only be supported, as per conventional exercise bars to an elevated height to enable the exercises to be performed.

Figure 5:
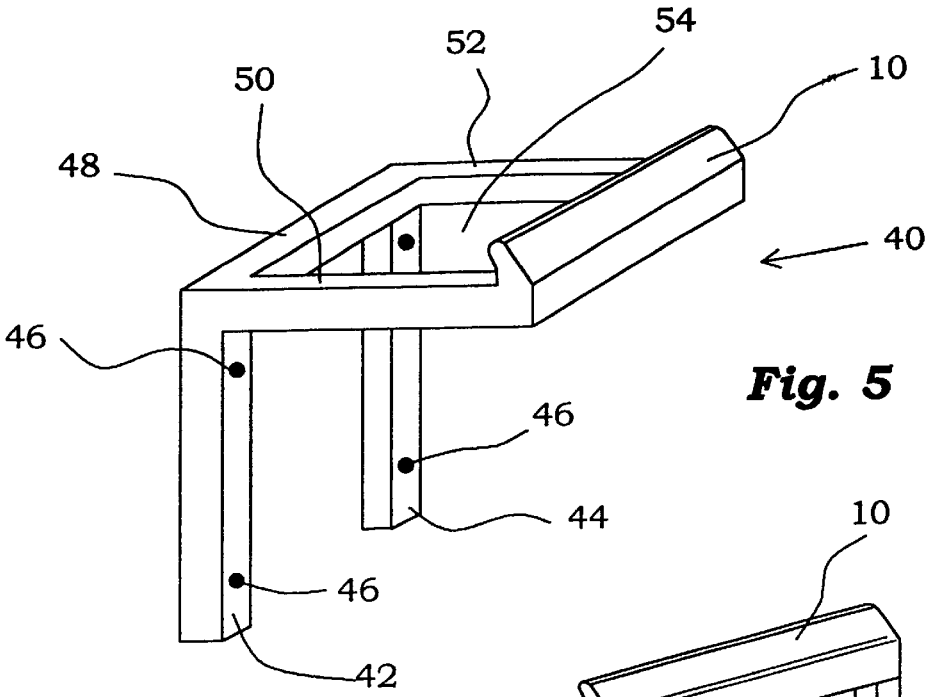
FIG. 5 is a perspective view of the exercise bar of the present invention formed upon a framework for mounting upon a wall.
Figure 6:
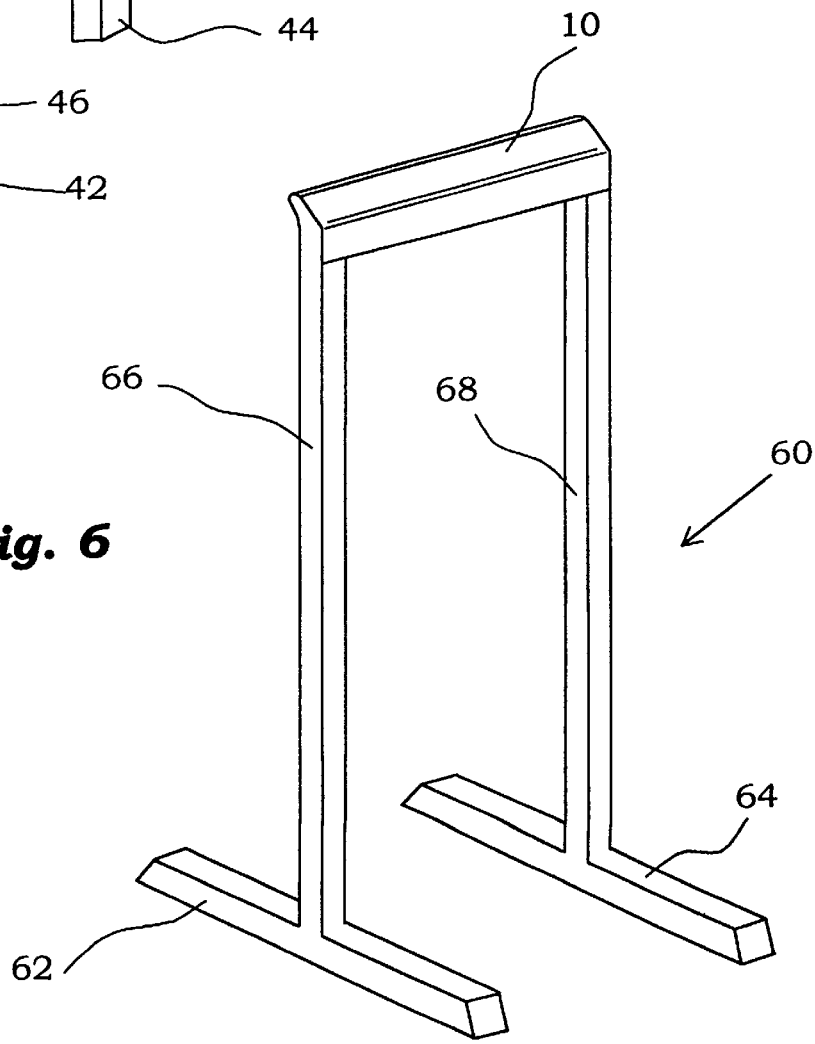
FIG. 6 is a perspective view of the exercise bar of the present invention formed upon a free-standing framework for use indoors or outdoors.

Along these lines, and as illustrated in FIGS. 5 and 6, respectively, there are shown additional embodiments 40, 60 of the exercise bar 10 of the present invention. Referring firstly to FIG. 5, there is shown the exercise bar 10 of the present invention as formed as part of a wall-mount unit 40. As shown, such wall-mount unit 40 preferably comprises first and second support beam members 42, 44 having apertures 46 formed thereon through which may be inserted fastening members, such as bolts and the like. A cross support beam 48 extending between support beam members 42, 44 is provided from which extend first and second arms 50, 52, the latter extending outwardly to support the bar 10 of the present invention. As will be appreciated by those skilled in the art, arms 50, 52 extend outwardly from cross-beam 48 such that there is defined a generally square or rectangular cavity 54 through which the head of an individual may extend to the extent the individual performs chin-up exercises. In this respect, it will be appreciated that such embodiment is meant to be mounted upon a wall, via conventional mounting techniques, such that the apparatus 40 is rigidly maintained at an elevated height to enable individuals to perform chin-up and pull-up exercises.

Similarly, as depicted in FIG. 6, there is shown a free-standing embodiment 60 of the exercise bar 10 of the present invention. In the embodiment shown, the exercise bar 10 is supported by first and second support members or feet 62, 64 from which respectively extend first and second support beams 66, 68, the latter being positioned in generally parallel relation to one another with the opposed sides of the exercise bar 10 extending thereacross. As will be appreciated, the embodiment shown may be placed either indoors or outdoors and requires no mounting. Rather, the free-standing apparatus shown enables individuals to merely extend their arms upwardly and grasp the exercise bar 10 elevated thereby so that chin-up and pull-up exercises may be freely performed. As will be appreciated in the embodiment shown in FIGS. 4 and 5, the exercise bar 10 may be formed as a unitary piece of molded material, as opposed to being formed from a sheet of rigid material as depicted in the embodiment shown in FIGS. 1, 2 and 4.

Figure 7:
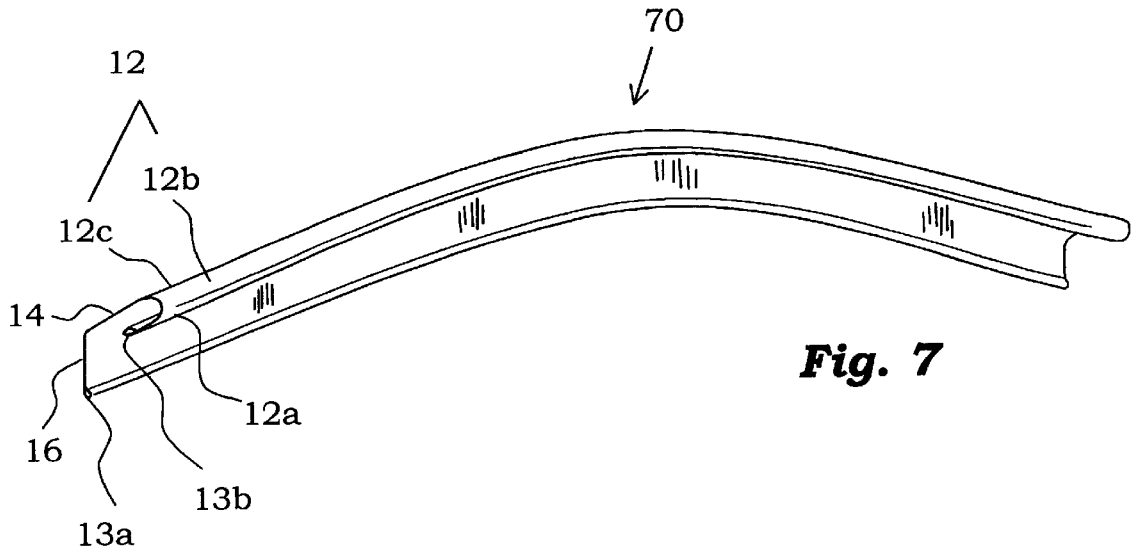
FIG. 7 is a perspective view of an improved exercise bar constructed in accordance with an alternative preferred embodiment of the present invention.

Referring now to FIG. 7, there is further depicted yet another embodiment 70 of the improved exercise bar of the present invention. As illustrated, the exercise bar 70 is formed to have a generally arcuate shape such that the opposed ends of such exercise bar having a generally downwardly-sloping configuration. Although arcuate, however, the bar 70 retains the zones or portions 12, 14, 16 for distributing the weight of an individual about the hands thereof when the individual grasps the same, as per the embodiment discussed above. The embodiment depicted in FIG. 7, however, is particularly useful in the performance of wide-grip pull-up exercises insofar as the downwardly-sloping arcuate portions of the exercise bar 70 accommodate and complement the orientation of the individual's hands during the performance of such exercises. In this regard, it is well-known that to properly perform wide-grip pull-up exercises, particular attention must be given to the angle at which the palms of the individual's hands are positioned during such exercises. Despite this recognition, prior art wide-grip exercise bars merely comprise the elongate tubular structures mentioned above that are merely bent downwardly at the opposed ends thereof, and thus are ill-suited to facilitate the performance of such exercises.

Figure 8:
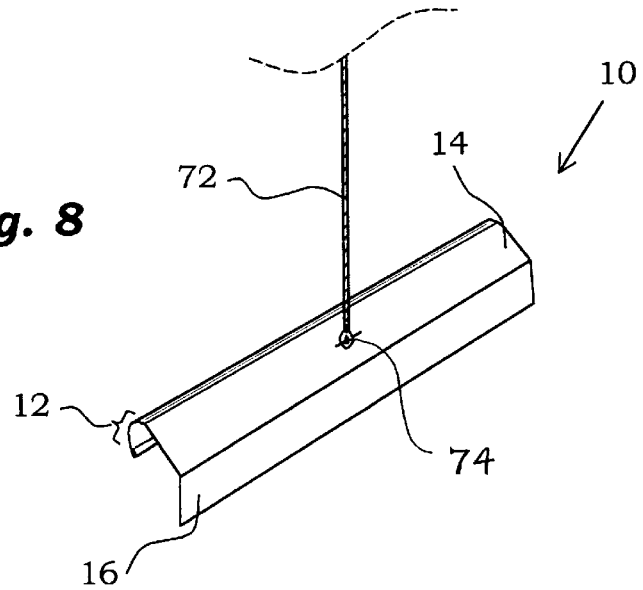
FIG. 8 is a perspective view of the improved exercise bar of FIG. 1 having an attachment mechanism formed thereon, the latter coupled to a tether for suspending such improved exercise bar.

Referring further still to FIG. 8, there is shown the exercise bar 10 of the present invention having an attachment mechanism 74 formed thereon to enable the same to be affixed to conventional workout machinery. Such attachment mechanism 74 thus permits the exercise bar 10 of the present invention to be supported by a tether 72, the latter affixed to a series of one or more groups of weights (not shown) for the performance of "lat pull-down" exercises. As is known, lat pull-down exercises are ideal for strengthening the latissimus dorsi muscles of the back. Advantageously, the exercise bar 10 of the present invention, by virtue of attachment mechanism 74, can be easily and readily substituted in place of conventional exercise bars attachable to any of variety of prior art exercise machines for performing lat pull-down exercises. In contrast to the prior art, however, the configuration of the exercise bar of the present invention enables such lat pull-down exercises to be performed in a manner that substantially reduces hand strain normally associated with the performance of such exercises.

Although the invention has been described herein with specific reference to a presently preferred embodiment thereof, it will be appreciated by those skilled in the art that various modifications, deletions, and alterations may be made to such preferred embodiment without departing from the spirit and scope of the invention. In this regard, it is believed that the exercise bar may be sized and configured to be utilized in any of a variety of muscle strengthening exercises as a substitute for conventional tubular devices. For example, it is contemplated that the exercise bar of the present invention may be sized and adapted for use in rowing-type exercises and the like. Accordingly, it is intended that all reasonably foreseeable additions, modifications, deletions and alterations be included within the scope of the invention as defined in the following claims.

What is claimed is:

1. An exercise bar for use by an individual in the performance of chin-up, pull-up and pull-down exercises comprising:

a) a rigid, elongate member said member having first and second opposed ends, said member defining a first upper arcuate phalangeal support portion having a generally inverted, downwardly oriented u-shape extending along the length thereof;

b) a second outwardly angled palmar support sidewall portion, said sidewall portion extending downwardly from a respective side of said first arcuate portion;

c) a third ulnar and radial support sidewall portion extending downwardly from said second sidewall portion to define an obtuse angle therebetween, said third sidewall portion being formed such that in use, said third sidewall portion assumes a generally perpendicular orientation relative to level ground; and d) wherein said first arcuate portion and said second angled sidewall portion collectively cooperate to define a grasping surface for the fingers and palmar surface of said individual's hands and said third sidewall portion defines a support surface for the distal portion of the individual's wrists during the performance of said exercises.

2. The exercise bar of claim 1 wherein said first arcuate portion of said panel member defines a first support area for supporting the distal phalanx bones of the little finger, ring finger, middle finger and index finger, a second support area for supporting the middle phalanx bones of the little finger, ring finger, middle finger and index finger, and a third support area for supporting the proximal phalanx bones of the little finger, ring finger, middle finger and index finger of each respective hand of said individual.

3. The exercise bar of claim 1 wherein said second angled sidewall portion defines a surface for supporting the first metacarpal, distal and proximal phalanx bones of the thumb, and second through fifth metacarpal, hamate, pisiform, capitate, triquetral, lunate, trapezium, trapezoid, and scaphoid bones of the lower portion of the palm of each respective hand of said individual when said individual performs said pull-up and chin-up exercises.

4. The exercise bar of claim 1 wherein said third sidewall defines a support surface for compressing against the distal-most portions of the ulna and radius bones of the wrist of said individual when said individual performs said pull-up and chin-up exercises.

5. The exercise bar of claim 1 wherein said elongate bar is formed from a sheet of metal selected from the group consisting of steel, iron, aluminum, titanium and combinations thereof.

6. The exercise bar of claim 1 wherein said exercise bar is molded as a unitary piece of plastic.

7. The exercise bar of claim 1 wherein said exercise bar is formed from wood.

8. The exercise bar of claim 1 wherein:

a) said first arcuate portion defines an elongate semi-cylindrical structure having a radius ranging between ½" to 2";

b) said second angled sidewall portion has a length ranging from 2" to 4";

c) said third sidewall portion has a length ranging from 2" to 6".

9. The exercise bar of claim 1 wherein said elongate member is formed to have an arcuate shape.

10. The exercise bar of claim 9 wherein said arcuate shape of said exercise bar defines downwardly-sloping first and second opposed ends for use by an individual in the performance of wide-grip pull-up exercises.

11. An apparatus for use by an individual in the performance of chin-up and pull-up exercises comprising:

a) at least one member for mounting said apparatus upon a wall;

b) first and second arm members extending from said mounting member; and c) an elongate exercise bar having first and second opposed ends, said first opposed end being mounted upon said first arm member and said second opposed member being mounted upon said second arm member, said exercise bar comprising:

i) a first arcuate upper portion having a generally inverted U-shape extending along the length thereof;

ii) a second outwardly angled sidewall portion, said sidewall portion extending downwardly from a respective side of said first arcuate portion;

iii) a third sidewall portion extending downwardly from said second sidewall portion, said third sidewall portion being formed such that in use, said third sidewall portion assumes a generally perpendicular orientation relative to level ground; and iv) wherein said first arcuate portion and said second angled sidewall portion cooperate to define a grasping surface for the fingers and palmar surface of said individual's hands and said third sidewall portion defines a support surface for the distal portion of the individual's wrists during the performance of said exercises.

12. The apparatus of claim 11 wherein said at least one mounting member comprises a unitary structure consisting of first and second elongate support beams spaced in generally parallel relation to one another and an elongate support beam extending therebetween and integrally formed therewith.

13. An apparatus for use by an individual in the performance of chin-up and pull-up exercises comprising:

a) a first support base member having an upwardly extending support member formed thereon;

b) a second support base member having an upwardly extending support member formed thereon wherein said second support beam extends in generally parallel relation to said first support beam; and c) a rigid, elongate exercise bar having first and second opposed ends, said first opposed end being rigidly connected to said first support beam and said second opposed end being rigidly mounted to said second support beam, said exercise bar comprising:

i) a first upper arcuate portion having a generally inverted U-shape extending along the length thereof;

ii) a second outwardly angled sidewall portion, said sidewall portion extending downwardly from a respective side of said first arcuate portion;

iii) a third sidewall portion extending downwardly from said second sidewall portion, said third sidewall portion being formed such that in use, said third sidewall portion assumes a generally perpendicular orientation relative to level ground; and iv) wherein said first arcuate portion and said second angled sidewall portion cooperate to define a grasping surface for the fingers and palmar surface of said individual's hands and said third sidewall portion defines a support surface for the distal portion of the individual's wrists during the performance of said exercises.

14. An exercise bar for use by an individual in the performance of chin-up, pull-up and pull-down exercises; comprising:

a) a rigid, elongate member having first and second opposed ends, said member defining a first upper arcuate portion having a generally inverted U-shape extending along the length thereof;

b) a second outwardly angled sidewall portion, said sidewall portion extending downwardly from a respective side of said first arcuate portion;

c) a third sidewall portion extending downwardly from said second sidewall portion; said third sidewall portion being formed such that in use, said third sidewall portion assumes a generally perpendicular orientation relative to level ground;

d) wherein said first arcuate portion and said second angled sidewall portion cooperate to define a grasping surface for the fingers and palmar surface of said individual's hands and said third sidewall portion defines a support surface for the distal portion of the individual's wrists during the performance of said exercises; and e) an attachment mechanism formed thereon for detachably engaging with a tether wherein said tether is affixed to one or more weights.

15. The exercise bar of claim 14 wherein said attachment mechanism enables said exercise bar to be attached to at least one of a multiplicity of weights stored within a weight-lifting apparatus.

16. An exercise bar for use by an individual in the performance of chin-up, pull-up and pull-down exercises comprising:

a) a rigid, elongate member, said member having first and second opposed ends, said member defining a first upper arcuate portion having a generally inverted u-shape extending along the length thereof;

b) a second outwardly angled sidewall portion, said sidewall portion extending downwardly from a respective side of said first arcuate portion;

c) a third sidewall portion extending downwardly from said second sidewall portion, said third sidewall portion being formed such that in use, said third sidewall portion assumes a generally perpendicular orientation relative to level ground;

d) wherein said first arcuate portion and said second angled sidewall portion cooperate to define a grasping surface for the fingers and palmar surface of said individual's hands and said third sidewall portion defines a support surface for the distal portion of the individual's wrists during the performance of said exercises; and e) wherein the first second and third portions cooperate to define opposed sides of the exercise bar, said opposed sides being engagable to at least one mounting member for supporting the weight of an individual in the performance of exercises.

* * * * *